US010897073B2

(12) United States Patent
Sato et al.

(10) Patent No.: US 10,897,073 B2
(45) Date of Patent: Jan. 19, 2021

(54) RECEIVER FOR DETECTING A TERAHERTZ WAVE AND IMAGE FORMING APPARATUS

(71) Applicant: CANON KABUSHIKI KAISHA, Tokyo (JP)

(72) Inventors: Takahiro Sato, Ebina (JP); Jun Iba, Yokohama (JP); Yoshinori Tateishi, Naka-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/545,816

(22) Filed: Aug. 20, 2019

(65) Prior Publication Data

US 2020/0067170 A1 Feb. 27, 2020

(30) Foreign Application Priority Data

Aug. 27, 2018 (JP) ..... 2018-157985
Jul. 4, 2019 (JP) ..... 2019-125295

(51) Int. Cl.

| | |
|---|---|
| ***H01Q 1/38*** | (2006.01) |
| ***H01Q 1/22*** | (2006.01) |
| ***H01Q 15/14*** | (2006.01) |
| *H01Q 9/16* | (2006.01) |
| *H01Q 7/00* | (2006.01) |

(52) U.S. Cl.

CPC ..... *H01Q 1/22* (2013.01); *H01Q 1/38* (2013.01); *H01Q 15/14* (2013.01); *H01Q 7/00* (2013.01); *H01Q 9/16* (2013.01)

(58) Field of Classification Search

CPC .. H01Q 1/22; H01Q 1/38; H01Q 7/00; H01Q 9/16; H01Q 15/14

See application file for complete search history.

(56) References Cited

U.S. PATENT DOCUMENTS

| | | | | |
|---|---|---|---|---|
| 7,709,797 | B2 * | 5/2010 | Sekiguchi | H01L 31/02162 250/339.01 |
| 9,391,428 | B2 | 7/2016 | Koyama | |
| 2013/0193324 | A1 * | 8/2013 | Sengupta | G01J 5/0837 250/338.4 |
| 2014/0126168 | A1 | 5/2014 | Fujita | |
| 2014/0198013 | A1 | 7/2014 | Saraswat | |
| 2015/0034825 | A1 * | 2/2015 | Debray | G01J 5/10 250/332 |
| 2015/0303559 | A1 | 10/2015 | Tateishi | |

(Continued)

FOREIGN PATENT DOCUMENTS

| | | |
|---|---|---|
| JP | 5909707 | 4/2016 |
| JP | 6122508 | 4/2017 |

(Continued)

*Primary Examiner* — Jason Crawford
(74) *Attorney, Agent, or Firm* — Venable LLP

(57) ABSTRACT

A receiver which is configured to detect a terahertz wave incident on a first surface of a substrate, the receiver comprising: an antenna which is provided on the first surface of the substrate and is configured to receive the terahertz wave; and a through electrode which is electrically connected to the antenna and penetrates the substrate from the first surface to a second surface, the second surface being opposite to the first surface, wherein the through electrode is separated from the antenna by a distance that is 0.25 times a resonance wavelength or more.

20 Claims, 11 Drawing Sheets

(56) References Cited

U.S. PATENT DOCUMENTS

| | | | | |
|---|---|---|---|---|
| 2015/0365611 | A1* | 12/2015 | Sekiguchi | G01S 17/89 250/208.1 |
| 2016/0036122 | A1* | 2/2016 | Debray | H01Q 21/061 250/338.1 |
| 2017/0059402 | A1* | 3/2017 | Debray | H01Q 9/0464 |
| 2017/0250458 | A1* | 8/2017 | Diebold | H01Q 9/28 |
| 2018/0266945 | A1* | 9/2018 | Kitaura | G01J 1/0252 |
| 2020/0072663 | A1* | 3/2020 | Tateishi | G01J 5/10 |
| 2020/0176421 | A1* | 6/2020 | Saito | H01L 21/76898 |

FOREIGN PATENT DOCUMENTS

| | | |
|---|---|---|
| WO | 2013/080560 | 6/2013 |
| WO | 2014/110273 | 7/2014 |

* cited by examiner

RECEIVER FOR DETECTING A TERAHERTZ WAVE AND IMAGE FORMING APPARATUS

BACKGROUND OF THE INVENTION

Field of the Invention

The present invention relates to a receiver for detecting a terahertz wave and an image forming apparatus.

Description of the Related Art

A heat-sensitive sensor such as a bolometer is sometimes used in an image forming apparatus using a terahertz wave that is a radio wave (an electromagnetic wave) with a frequency of at least 0.03 THz and not more than 30 THz. However, such an image forming apparatus is susceptible to low-frequency noises such as 1/f noise and, furthermore, since it is difficult to increase a frame rate in moving picture imaging, achieving noise reduction is difficult. In consideration thereof, image forming apparatuses that combine an antenna for receiving a terahertz wave and a circuit such as a semiconductor element are being devised and, according to such a configuration, increased processing speed and noise reduction of an image forming apparatus can be realized.

Specifically, image forming apparatuses are proposed in which individual antennas provided on a substrate front surface of a chip and a circuit for performing signal processing and the like provided on a substrate rear surface side are connected to each other by a through electrode and configured as a single device. Japanese Patent No. 6122508 discloses a rear surface rewiring layer patch antenna in which a patch antenna (a microstrip antenna) fabricated on a substrate front surface and a circuit fabricated on a substrate rear surface are mutually electrically connected by a through electrode provided at a location positioned on a rear side of the patch antenna. Japanese Patent No. 5909707 discloses a wireless module in which a patch antenna fabricated on a substrate front surface and a semiconductor element disposed on a substrate rear surface side are electrically connected to each other via a wiring pattern (a microstrip line) led out from the patch antenna and a through electrode.

In both cases of prior art described above, a single device is constructed by connecting a through electrode that penetrates a substrate to a rear side of a patch antenna fabricated on a substrate front surface or to a wiring led out from the patch antenna and electrically connecting a circuit on a substrate rear surface side to the substrate. In addition, when using a patch antenna to receive a terahertz wave, since a disturbance of an electric field of a patch antenna rear surface hardly affects a radiation direction of the antenna, a relative positional relationship between the patch antenna and the through electrode has not been taken into consideration.

Furthermore, antennas such as a loop antenna and a dipole antenna provided on a substrate have a higher degree of design freedom than a patch antenna. Specifically, by adjusting an antenna length or adding a reflective plate, or due to an antenna peripheral structure, directionality of an antenna can be adjusted so as to be suitable for use as an image forming apparatus for photographing images. In other words, by using an antenna such as a loop antenna or a dipole antenna as an on-chip antenna, an image forming apparatus can be used as a suitable receiver of a terahertz wave.

SUMMARY OF THE INVENTION

However, since an antenna such as a loop antenna or a dipole antenna provided on a substrate is constituted by a metallic line unlike a patch antenna constituted by a metal flat plate, a larger proportion of a received terahertz wave propagates through the substrate as compared to a patch antenna. Therefore, a terahertz wave ends up being propagated to the through electrode present in the substrate. In addition, the propagation to the through electrode may significantly affect the radiation direction of the terahertz wave and cause a receiving sensitivity of the terahertz wave to decline in an image forming apparatus (receiver; element).

The present invention has been made in consideration of the above and an object thereof is to provide a receiver of a terahertz wave in which an antenna and a circuit for performing signal processing are connected to each other by a through electrode, the receiver suppressing a decline in receiving sensitivity of the terahertz wave.

One aspect of the present invention is a receiver which is configured to detect a terahertz wave incident on a first surface of a substrate, the receiver comprising:

an antenna which is provided on the first surface of the substrate and is configured to receive the terahertz wave; and a through electrode which is electrically connected to the antenna and penetrates the substrate from the first surface to a second surface, the second surface being opposite to the first surface, wherein the through electrode is separated from the antenna by a distance that is 0.25 times a resonance wavelength or more.

According to the present invention, even with a receiver of a terahertz wave in which an antenna and a circuit for performing signal processing are connected to each other by a through electrode, a decline in receiving sensitivity of the terahertz wave can be suppressed.

Further features of the present invention will become apparent from the following description of exemplary embodiments with reference to the attached drawings.

DESCRIPTION OF THE EMBODIMENTS

First Embodiment

In a first embodiment, a receiver will be described which has a through electrode that connects a drive circuit for controlling a signal output from a loop antenna and the loop antenna to each other, which detects a terahertz wave, and which is configured such that the loop antenna and the through electrode are separated from each other by a certain distance or more. According to such a configuration, since an effect of the through electrode on a radiation direction of the loop antenna can be suppressed, a decline in receiving sensitivity of the receiver with respect to a terahertz wave can be suppressed.

Configuration of Drive Circuit

In the present embodiment, a receiver (element) which detects a terahertz wave incident via a lens will be described. In this case, the receiver has a plurality of antennas that receive a terahertz wave, and a drive circuit controls signals respectively output from the plurality of antennas to receive the terahertz wave.

Figure 1:
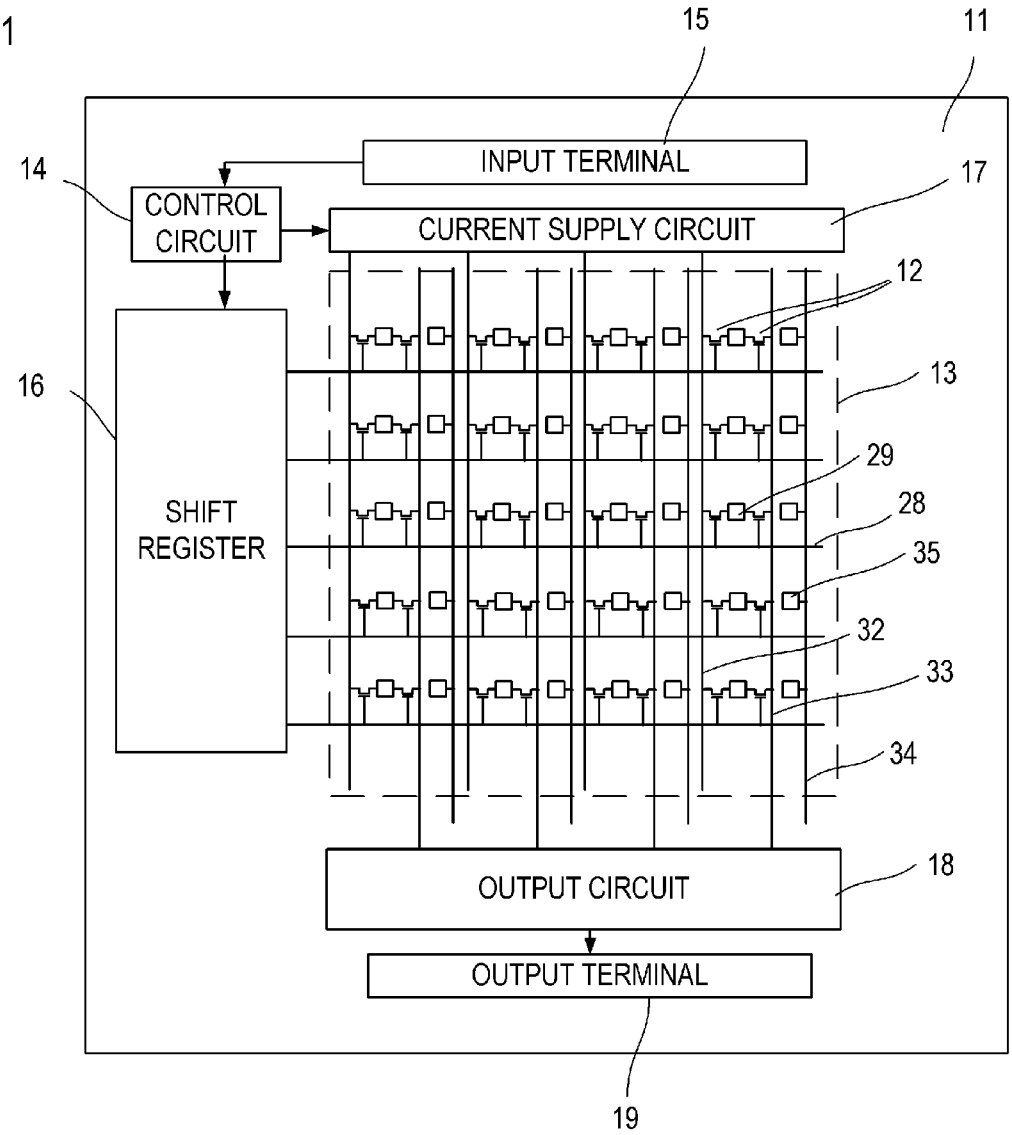
FIG. 1 is a configuration diagram of a drive circuit according to a first embodiment.

FIG. 1 shows a schematic configuration diagram of the drive circuit included in the receiver according to the present embodiment. The drive circuit according to the present embodiment has a drive circuit substrate 11 made of a semiconductor. The drive circuit substrate 11 is, for example, a silicon substrate. In addition, the drive circuit has a pixel control region 13 and a peripheral circuit (an integrated circuit) on the drive circuit substrate 11. Moreover, in the pixel control region 13, an electrode pad 29 and an electrode pad 35 which are connected to an antenna constituting a pixel provided on a separate substrate and a CMOS switch 12 which controls a connection between the antenna and the drive circuit are arranged in a regular two-dimensional array. Although a description will be given later with reference to FIGS. 2 and 3, a surface of the drive circuit substrate 11 on which the peripheral circuit is provided is covered by a wiring structure 20 having an insulating film, and a row wiring 28, a column wiring 32, a signal line 33, and a ground wiring 34 which constitute a part of the drive circuit substrate 11 are arranged in the wiring structure 20.

Figure 8:
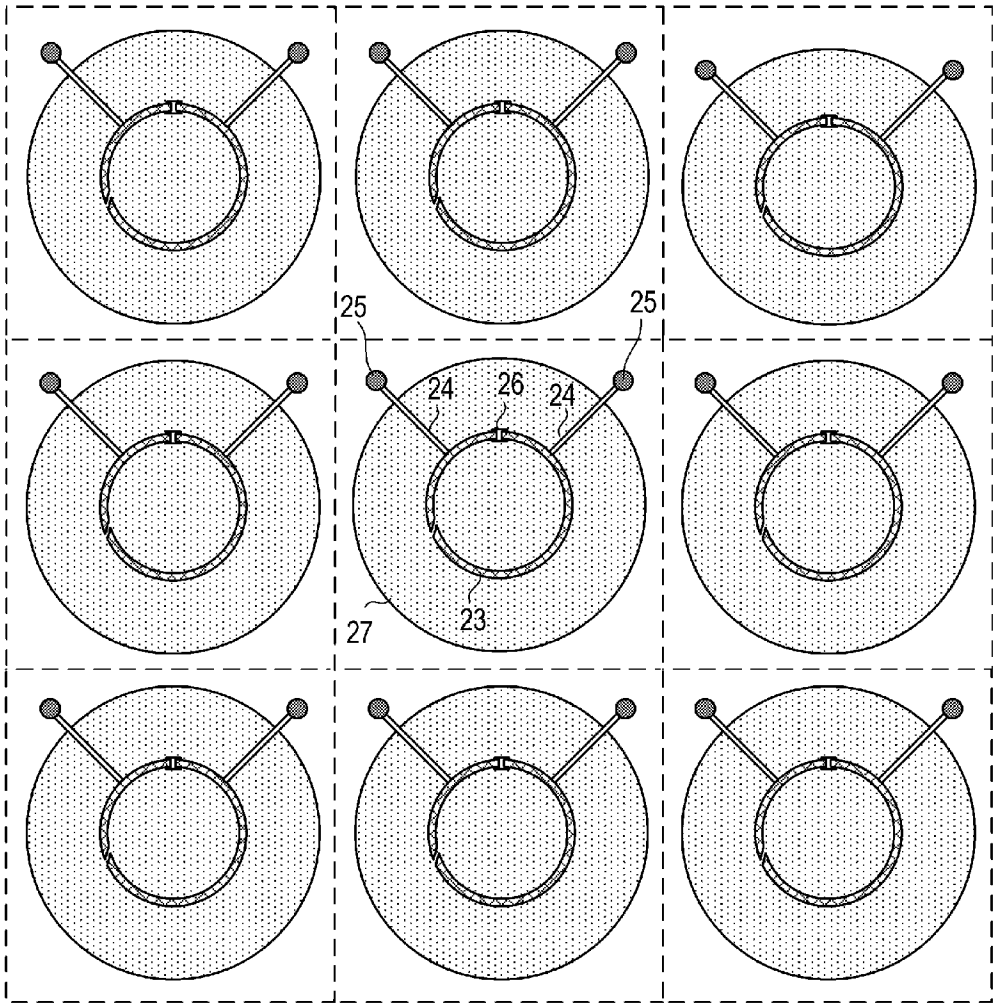
FIG. 8 is a diagram showing an illustrative arrangement of a reflective plate according to the first embodiment.

In the present embodiment, one antenna corresponds to each one of the electrode pads 29 shown in FIG. 1, and each of the antennas corresponds to one pixel. In other words, as shown in FIG. 8 which is a perspective view of the receiver from a direction of incidence of a terahertz wave, the receiver according to the present embodiment has a plurality of antennas (resonant antennas 23). In addition, in the present embodiment, a pixel refers to each one of the regions enclosed by dash lines in FIG. 8.

The peripheral circuit (the integrated circuit) is constituted by a control circuit 14, a shift register 16, a current supply circuit 17, and an output circuit 18. In the present embodiment, one peripheral circuit is present with respect to the plurality of antennas.

The control circuit 14 performs a process of receiving a clock that drives the receiver from an input terminal 15 and delivering the clock to the shift register 16, a process of generating voltage for determining a current level for driving an antenna portion to be generated by the current supply circuit 17, and the like.

The shift register 16 drives pixels in row units by sequentially selecting a row wiring that drives an antenna portion (a pixel) and supplying pulse voltage for switching the CMOS switch 12 ON/OFF to the selected row wiring 28.

The current supply circuit 17 generates a current for driving an antenna portion on the basis of a voltage signal for current level determination issued by the control circuit 14. Specifically, the current supply circuit 17 generates a current through the column wiring 32, each antenna connected to the column wiring 32, and the ground wiring 34.

The output circuit 18 amplifies an electric signal supplied through the signal line 33 in accordance with an intensity of a terahertz wave received by an antenna portion constituting a pixel and outputs the amplified electric signal to the outside of the receiver via an output terminal 19. The output circuit 18 may be disposed in an outer peripheral region of the pixel control region 13 or may be disposed on an antenna substrate to be described later. In particular, positioning a circuit such as an amplifier in proximity of the antenna substrate has a noise reduction effect.

Connection between Antenna Substrate and Drive Circuit Substrate

Figure 2:
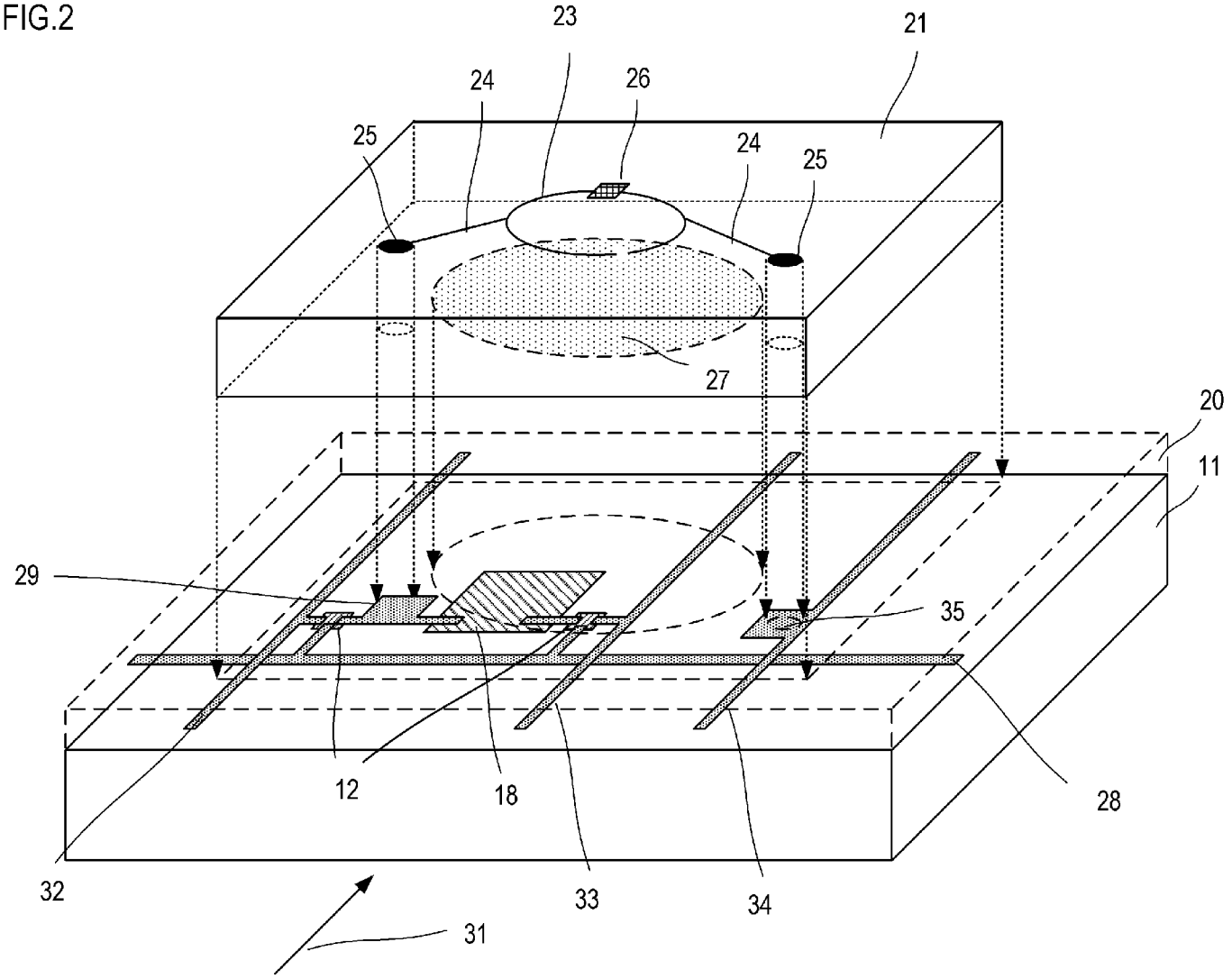
FIG. 2 is a bird's eye view showing a connection between an antenna substrate and a drive circuit substrate according to the first embodiment.
Figure 3:
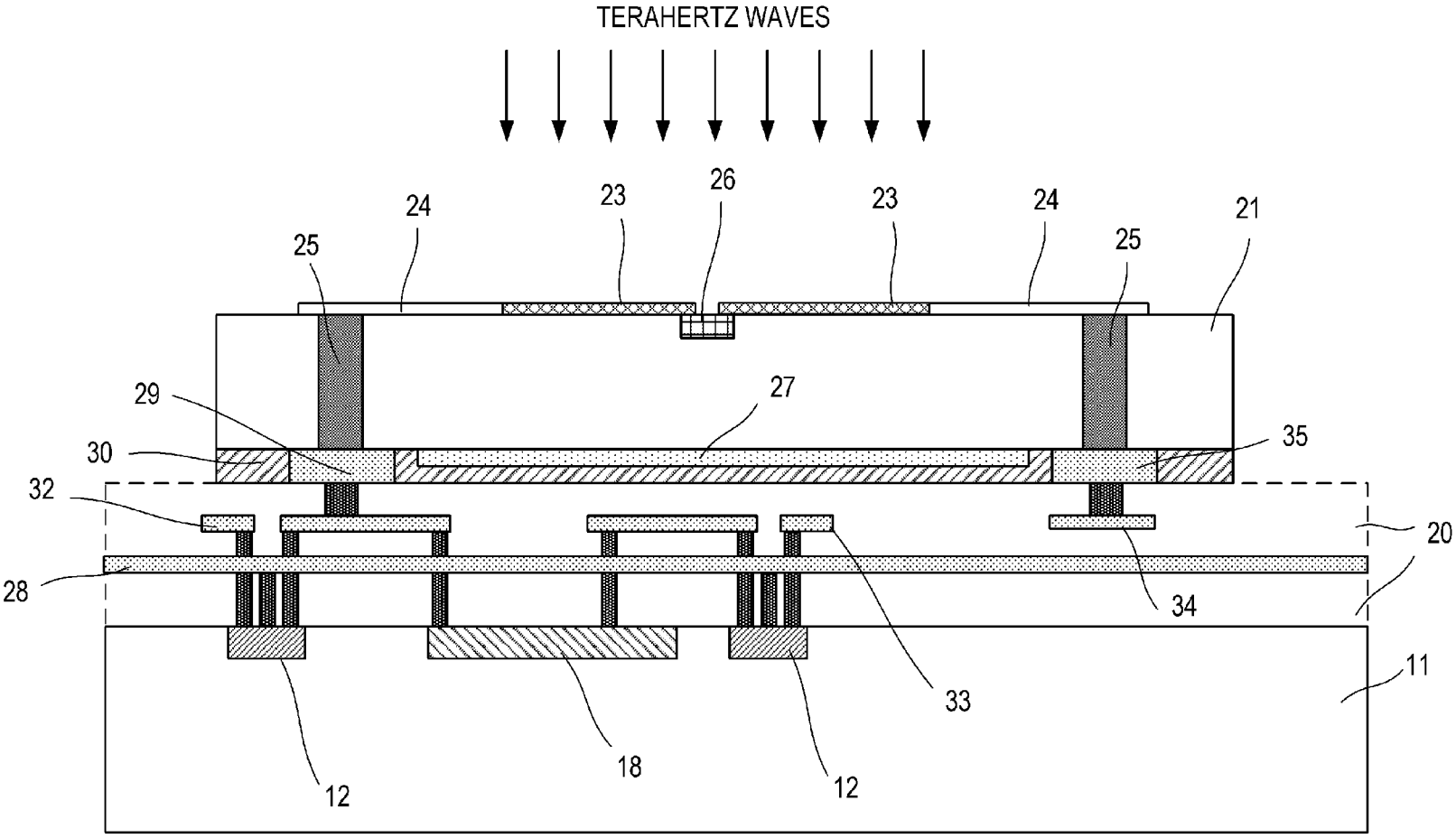
FIG. 3 is a side perspective view showing a connection between the antenna substrate and the drive circuit substrate according to the first embodiment.

Next, FIGS. 2 and 3 show schematic configuration diagrams related to a connection between the drive circuit substrate 11 and an antenna substrate 21 which is configured to receive a terahertz wave according to the present embodiment. In this case, in the receiver, the antenna substrate 21 having loop antennas that receive a terahertz wave arranged in a two-dimensional array and the drive circuit substrate 11 described with reference to FIG. 1 are electrically connected to each other. In addition, physically, in the receiver, the antenna substrate 21 and the drive circuit substrate 11 are joined to each other so as to sandwich the wiring structure 20 having an insulating film. Although FIGS. 2 and 3 show a connection of two substrates at one pixel, in reality, the receiver is constituted by a plurality of pixels as described above.

As shown in FIG. 2, the antenna substrate 21 made of a semiconductor such as a silicon semiconductor has a resonant antenna 23, a lead-out line 24, a through electrode 25, a rectifying element 26, and a reflective plate 27.

The resonant antenna 23 is a loop antenna which is made of a conductive metallic material and which is disposed on a first surface side of the antenna substrate 21. The lead-out line 24 is a conductive metallic material which supplies a drive current or drive voltage to the rectifying element 26 connected to the resonant antenna 23. The through electrode 25 penetrates the antenna substrate 21 and electrically connects the first surface and a second surface of the antenna substrate 21 to each other by penetrating the first surface and the second surface. The rectifying element 26 is connected to the resonant antenna 23 and has non-linear current-voltage characteristics. The reflective plate 27 is a metallic flat surface for adjusting directionality of the resonant antenna 23. It should be noted that the first surface of the antenna substrate 21 is a surface on which a terahertz wave is incident with respect to the antenna substrate 21, and the second surface of the antenna substrate 21 is a surface which is opposite to the first surface and which is on a side to be connected to the drive circuit substrate 11. Details of each component will be described in detail later.

The drive circuit substrate 11 in FIG. 2 represents an illustration of a part of the drive circuit substrate 11 shown in FIG. 1, and the part corresponds to one pixel on the antenna substrate 21. In other words, the portion of the drive circuit substrate 11 illustrated in FIG. 2 can be described as being in operation with respect to one pixel. Specifically, the drive circuit substrate 11 in FIG. 2 primarily illustrates the CMOS switch 12 for controlling ON/OFF of the resonant antenna 23 (pixel), the output circuit 18 constituting an amplifier or the like, and the electrode pad 29. In addition, the row wiring 28, the column wiring 32, the signal line 33, and the ground wiring 34 are disposed in the wiring structure 20, and a current from the through electrode 25 can be transmitted to the output circuit 18 using the wirings.

A position of the electrode pad 29 as viewed from a vertical direction of the antenna substrate 21 is the same as that of the through electrode 25, and the electrode pad 29 is provided on the row wiring 28 which is electrically connected to the through electrode 25. It should be noted that the vertical direction of the antenna substrate 21 is assumed to be a direction in which a terahertz wave is incident with respect to the antenna substrate 21 and which is opposite to a direction in which the drive circuit substrate 11 is connected to the antenna substrate 21.

FIG. 3 is a diagram which shows the antenna substrate 21 and the drive circuit substrate 11 described with reference to FIG. 2 being joined to each other and which represents a perspective view from a direction of an arrow 31 in FIG. 2. In addition, in FIG. 3, a unit integrating the drive circuit substrate 11 and the wiring structure 20 are bonded to the antenna substrate 21 via an adhesive 30. Bonding by the adhesive 30 can be performed by various methods, and other methods such as bonding by soldering and atomic diffusion bonding can also be adopted. By any of these bonding methods, the through electrode 25 provided on the antenna substrate 21 and the electrode pad 29 provided on the drive circuit substrate 11 are electrically connected to each other.

Disposing the respective components of the receiver as described above enables a terahertz wave to be detected. Specifically, the resonant antenna 23 (a loop antenna) receives a terahertz wave incident from the vertical direction (an upper surface) of the antenna substrate 21. In addition, due to an action of the rectifying element 26 connected to the resonant antenna 23, a wave detection current (an electric signal) in accordance with the received terahertz wave is generated. The generated wave detection current flows into the output circuit 18 provided on the drive circuit substrate 11 via the through electrode 25. The output circuit 18 subjects the received current to a process of converting the current into a voltage value, a process of amplifying a signal, and the like and outputs the processed current as a signal to the output terminal 19.

Resonant Antenna 23 and Peripheral Wirings of Resonant Antenna 23

Figure 4:
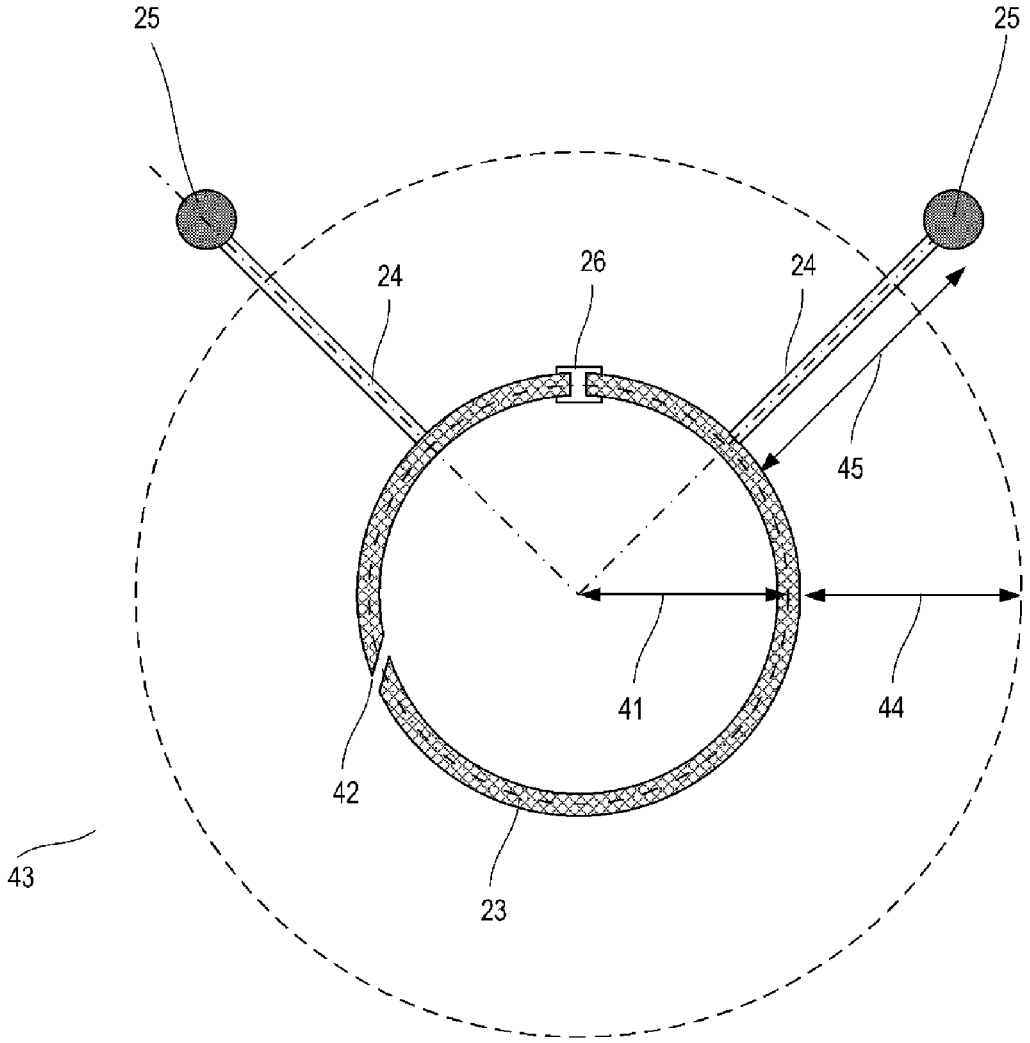
FIG. 4 is a diagram showing a resonant antenna and peripheral wirings according to the first embodiment.

Next, details of the resonant antenna 23 and the peripheral wirings of the resonant antenna 23 described above will be provided. FIG. 4 is a plan view showing the resonant antenna 23 and the peripheral wirings of the resonant antenna 23 according to the first embodiment as seen from the vertical direction of the antenna substrate 21.

The resonant antenna 23 is made of a conductive metallic thin film such as aluminum and is provided on the antenna substrate 21 (not illustrated). In this case, the resonant antenna 23 and the antenna substrate 21 are in contact with each other via insulating film such as $SiO_2$ or SiN so that an electrical connection is not established between the resonant antenna 23 and the antenna substrate 21. The resonant antenna 23 is provided with a notch 42 for driving the rectifying element 26, and a drive voltage or current can be applied to both ends of the rectifying element 26 from the drive circuit substrate 11 via the two through electrodes 25 and the lead-out line 24. In the present embodiment, the lead-out line 24 is formed using a same material as the resonant antenna 23 and extends perpendicular to a tangent to a loop portion of the resonant antenna 23.

In addition, a length of a circumference of the resonant antenna 23 which is a resonator length can be determined by a resonant frequency (a design resonant frequency; a frequency of a received terahertz wave) of the resonant antenna 23. Specifically, with respect to a wavelength $\lambda$ (a resonance wavelength $\lambda$) in the resonant antenna 23 of a radio wave with a frequency selected as the resonant frequency, a length of the circumference of the resonant antenna 23 may be set to around $(n+0.5)\times\lambda$ (where n is 0 or a natural number) such as $0.5\lambda$, $1.5\lambda$, or $2.5\lambda$. In other words, setting the length of the resonant antenna 23 to any of 0.5 times, 1.5 times, 2.5 times, and so on of the resonance wavelength $\lambda$ of the antenna enables the resonant antenna 23 to receive a terahertz wave with a frequency corresponding to the resonance wavelength $\lambda$.

It should be noted that a resonance wavelength of a given object represents a wavelength when a terahertz wave received by the receiver (the resonant antenna 23) propagates through the object. Specifically, the resonance wavelength of the resonant antenna 23 represents a wavelength of a terahertz wave at which the resonant antenna 23 resonates when the terahertz wave propagates through the resonant antenna 23. Therefore, a resonance wavelength in air, a resonance wavelength of the resonant antenna 23, and a resonance wavelength of the antenna substrate 21 are all different values. The resonance wavelength of the resonant antenna 23 can be expressed by a value combining relative permittivities of air surrounding the resonant antenna 23, the antenna substrate 21, the insulating film that bonds the resonant antenna 23 and the antenna substrate 21 to each other, and the like.

In the present embodiment, the length of the circumference of the resonant antenna 23 is adjusted to $1.5\lambda$ with respect to the wavelength $\lambda$ (the resonance wavelength $\lambda$) of the resonant frequency (the design resonant frequency) of the resonant antenna 23. In other words, when a radius 41 of the resonant antenna 23 is denoted by r, r and the resonance wavelength $\lambda$ satisfy a relationship expressed as $2\pi r=1.5\lambda$. When downsizing the resonant antenna 23, the length of the circumference of the resonant antenna 23 may be adjusted to $0.5\lambda$ so that a relationship expressed as $2\pi r=0.5\lambda$ is satisfied. On the other hand, when increasing a receiving area of the resonant antenna 23, the length of the circumference of the resonant antenna 23 may be adjusted to $(n+0.5)\times\lambda$ by increasing the value of the natural number n. However, since adjusting the length of the circumference of the resonant antenna 23 also causes an impedance of the resonant antenna 23 that is a loop antenna to change, impedance matching (impedance adjustment) with the rectifying element 26 must be performed.

In the present embodiment, the rectifying element 26 is disposed on the antenna substrate 21. In addition, the rectifying element 26 is electrically connected to the resonant antenna 23 via a contact hole opened in the insulating film that insulates the resonant antenna 23 and the antenna substrate 21 from each other. Furthermore, in order to detect a frequency of a terahertz wave, an element with high-speed switching characteristics such as a Schottky barrier diode is desirably used as the rectifying element 26. However, besides a Schottky barrier diode, a rectifying diode such as a diode using a p-n junction can also be used as the rectifying element 26.

In addition, in the present embodiment, a boundary of a region 43 suitable for disposing the through electrode 25 is assumed to be a position of a region distance 44 which is a prescribed distance from the resonant antenna 23. Specifically, in the present embodiment, the region distance 44 represents a minimum value of a distance 45 between the resonant antenna 23 and the through electrode 25 under a condition in which the receiver can efficiently receive a terahertz wave. In this case, the distance 45 between the resonant antenna 23 and the through electrode 25 is a shortest distance between a loop-shaped portion of the resonant antenna 23 and the through electrode 25. Moreover, in the present embodiment, the distance 45 is also a length of the lead-out line 24. Furthermore, although a detailed description will be provided later, the region distance 44 is preferably 0.25λ or more (0.25 times or more) with respect to the resonance wavelength λ of the resonant antenna 23. Specifically, when the through electrode 25 is disposed so that the distance 45 is shorter than 0.25λ, directionality of the resonant antenna 23 weakens and further disturbance occurs.

Figure 5A:
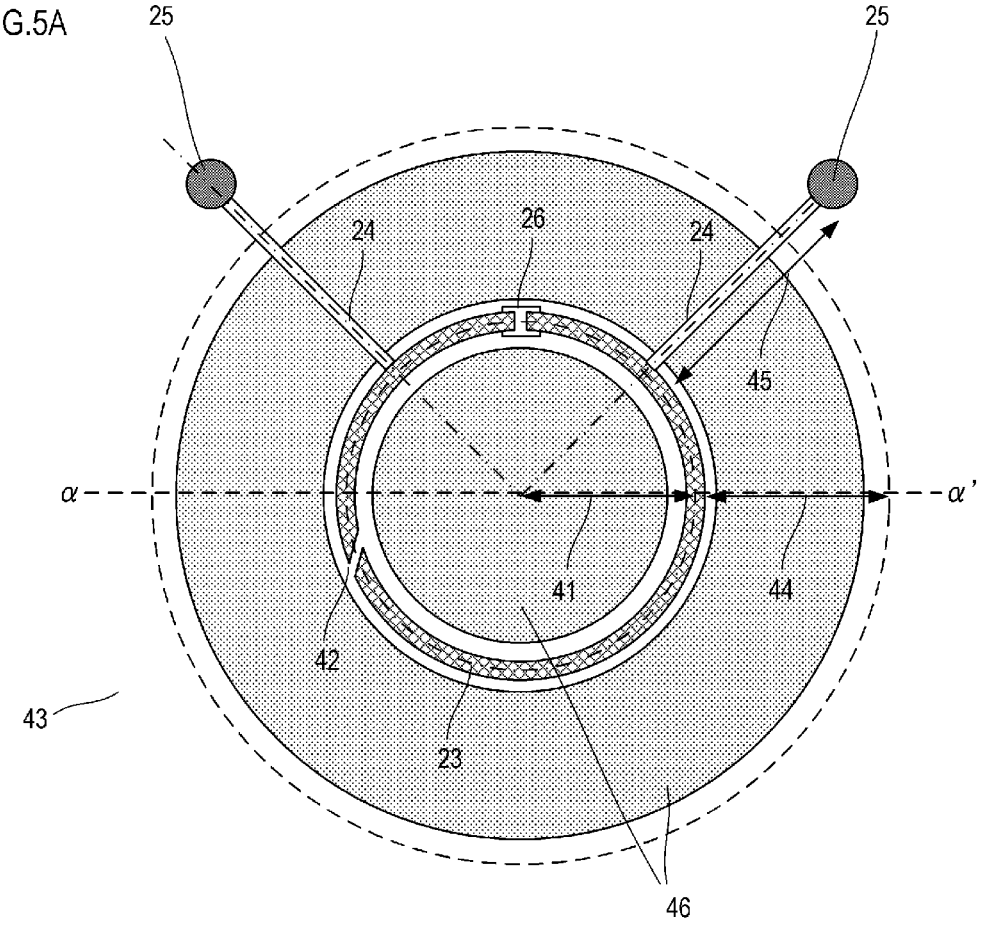
FIGS. 5A and 5B are diagrams showing the resonant antenna and the peripheral wirings according to the first embodiment.
Figure 5B:
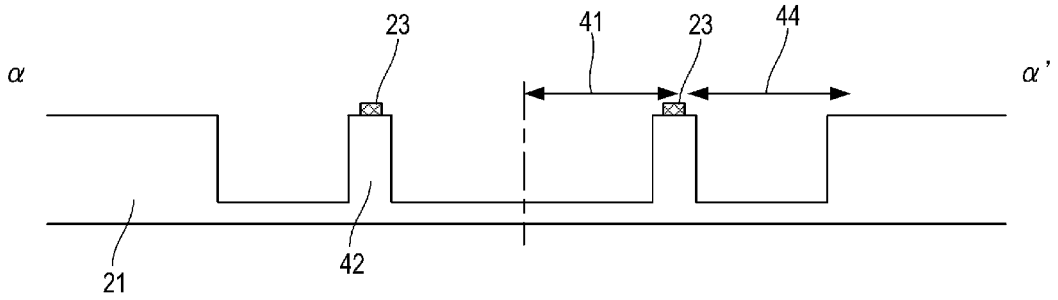

It should be noted that a reception efficiency of a terahertz wave may be improved by changing a shape of the antenna substrate 21. FIG. 5A shows the antenna substrate 21 described with reference to FIG. 4 being provided with a substrate-removed region 46 by etching a region not included in the region 43. In other words, in FIG. 5A, a region of the antenna substrate 21 within the region distance 44 from the resonant antenna 23 is subjected to a process of reducing a thickness of the antenna substrate 21. In addition, FIG. 5B represents an α-α' cross section in FIG. 5A.

When fabricating an antenna on the antenna substrate 21, a loss due to propagation of a terahertz wave in the antenna substrate 21 is known to occur. Specifically, when the thickness of the antenna substrate 21 increases, the number of modes in which a terahertz wave propagates increases, resulting in power loss of a terahertz wave that can be received. Therefore, as shown in FIG. 5B, by partially reducing the thickness of the antenna substrate 21 and reducing intra-substrate propagation modes of a terahertz wave, a reduction in reception power loss can be achieved.

Relationship between Antenna Gain and Distance 45

Figure 6:
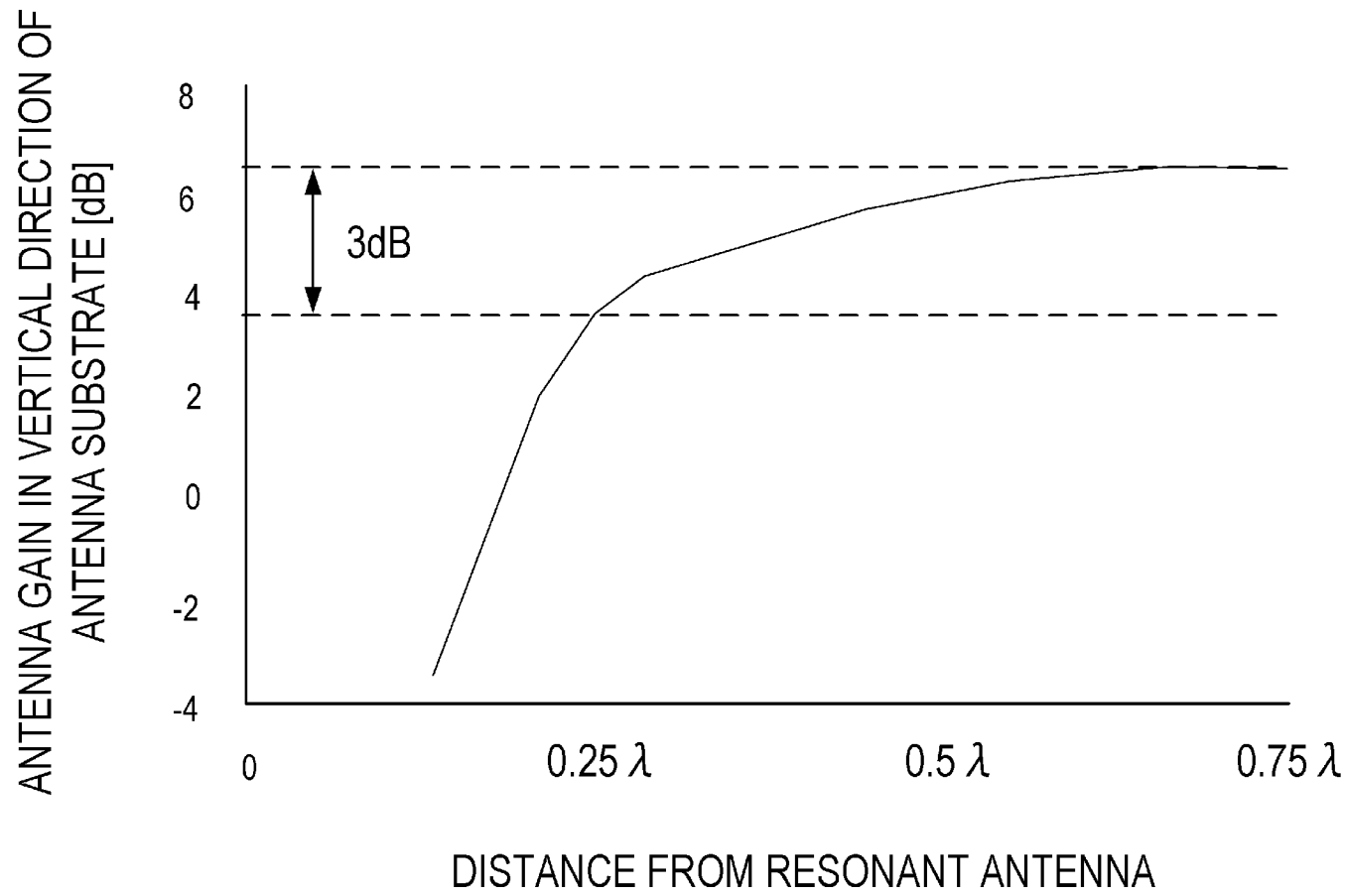
FIG. 6 is a graph showing an antenna gain of the resonant antenna according to the first embodiment.

FIG. 6 is a graph showing a relationship between an antenna gain in a vertical direction of the antenna substrate 21 in the resonant antenna 23 and the distance 45.

An ordinate represents an antenna gain of the resonant antenna 23 in the vertical direction of the antenna substrate 21 and indicates that the larger the value thereof, the stronger the directionality of the resonant antenna 23 with respect to the vertical direction of the antenna substrate 21. In other words, the greater the value of the ordinate, the higher the sensitivity by which the receiver is capable of receiving a terahertz wave irradiated from the vertical direction of the antenna substrate 21. An abscissa represents, using the resonance wavelength λ of the resonant antenna 23, the distance 45 which is the distance between the resonant antenna 23 and the through electrode 25.

Unlike an antenna constituted by a metallic flat plate such as a patch antenna, since the resonant antenna 23 which is a loop antenna is constituted by a linear piece of metal and is incapable of widely covering the antenna substrate 21, a terahertz wave more readily propagates into the antenna substrate 21. Therefore, when using the resonant antenna 23 which is a loop antenna, a terahertz wave propagates into the antenna substrate 21 and the directionality of the resonant antenna 23 ends up being disturbed by reception, re-radiation, and the like of the terahertz wave by the through electrode 25 which is present inside the antenna substrate 21. In comparison, by separating the resonant antenna 23 from the through electrode 25, effects of reception and re-radiation of a terahertz wave by the through electrode 25 can be suppressed and the antenna gain of the resonant antenna 23 in the vertical direction can be increased.

In addition, as shown in FIG. 6, when the distance 45 is 0.25λ, the antenna gain in the vertical direction declines by around 3 dB from a saturation value (a maximum value) in a case where the distance 45 is 0.75λ or more. In other words, when the distance 45 is 0.25λ, the antenna gain decreases to around ½ of the maximum value. When the distance 45 is made even shorter than 0.25λ, the antenna gain declines abruptly and an advantage of the directionality as compared with a patch antenna is diminished. In consideration thereof, the distance 45 is desirably set to 0.25λ or more with respect to a position where the through electrode 25 is disposed. Moreover, since the antenna gain in the vertical direction assumes a saturation value when the distance 45 is 0.75λ, the distance 45 may be set to a numerical value that is at least 0.25λ and not more than 0.75λ (at least 0.25 times and not more than 0.75 times the resonance wavelength λ of the resonant antenna 23). In addition, by setting the distance 45 to 0.25λ, since a size of each individual pixel can be suppressed while also suppressing a decline in the antenna gain, a larger number of the resonant antennas 23 can be mounted to the antenna substrate 21.

Figure 7A:
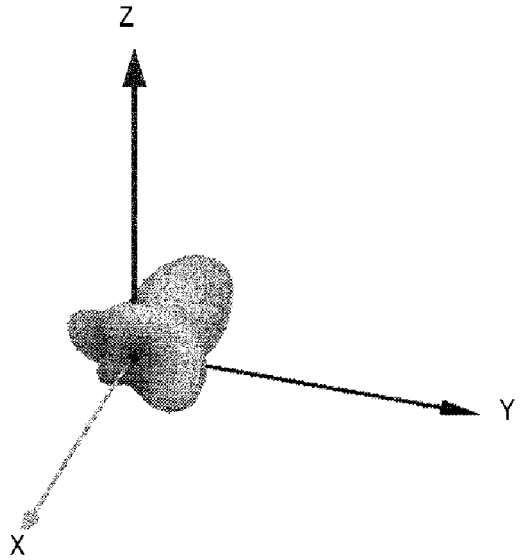
FIGS. 7A to 7C are diagrams showing a radiation pattern of the resonant antenna according to the first embodiment.
Figure 7B:
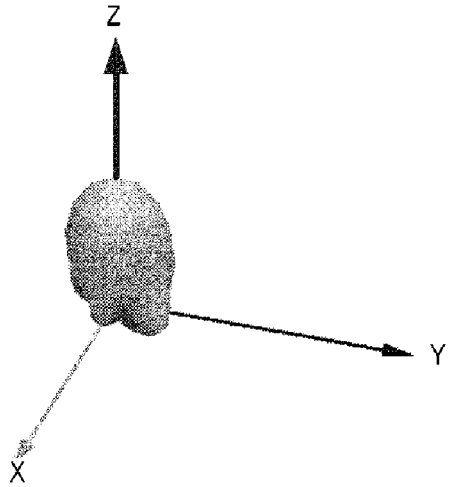
Figure 7C:
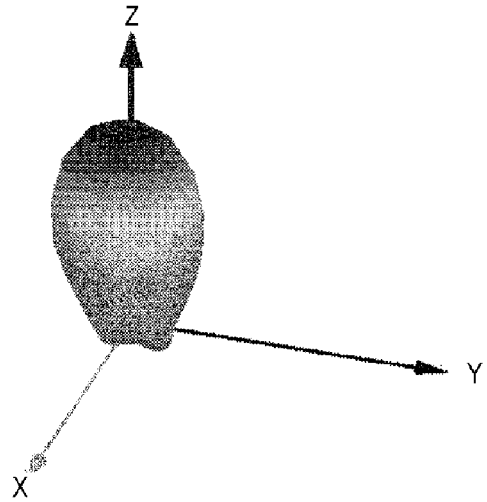

FIGS. 7A to 7C are diagrams showing a relationship between a radiation pattern of the resonant antenna 23 and the distance 45 according to the present embodiment. The radiation patterns shown in FIGS. 7A to 7C represent results of an analysis performed using an electromagnetic field simulator ("HFSS" manufactured by ANSYS, Inc.). The radiation patterns reveal a relationship between a direction of incidence of a terahertz wave and an antenna gain (a receiving sensitivity) of the resonant antenna 23 with a position of the antenna substrate 21 as a reference. Since basic antenna characteristics such as radiation patterns are the same regardless of whether the resonant antenna 23 is used for transmission or reception, a relationship between the receiving sensitivity and an orientation of the resonant antenna 23 may be discerned from a radiation pattern of the resonant antenna 23. Specifically, in each of FIGS. 7A to 7C, a Z axis represents a magnitude of the antenna gain in the vertical direction with respect to the resonant antenna 23, and X and Y axes represent a magnitude of the antenna gain in horizontal directions with respect to the resonant antenna 23. In other words, the greater the degree to which the radiation patterns in FIGS. 7A to 7C extend in a position direction of the Z axis, the larger the antenna gain in the vertical direction of the resonant antenna 23.

FIG. 7A represents a radiation pattern of the resonant antenna 23 when the distance 45 is 0.19λ. When the distance 45 is 0.19λ, the antenna gain has a maximum value in a direction horizontal to the antenna substrate 21. On the other hand, since the antenna gain in the position direction of the Z axis is small, sensitivity with respect to a terahertz wave incident from the vertical direction of the antenna substrate 21 is low. In addition, since the radiation pattern is not concentrated in the vertical direction of the antenna substrate 21, the resonant antenna 23 ends up receiving a reflected wave and a scattered wave other than a terahertz wave arriving at the pixel (the resonant antenna 23) directly from a lens and, consequently, noise increases in a received radio wave.

FIG. 7B represents a radiation pattern of the resonant antenna 23 when the distance 45 is 0.23λ. In this case, the antenna gain has a maximum value in a direction vertical with respect to the antenna substrate 21. In other words, this indicates that, compared to the case where the distance 45 is 0.19λ, an effect of the through electrode 25 on the radiation direction of the resonant antenna 23 has decreased.

FIG. 7C represents a radiation pattern of the resonant antenna 23 when the distance 45 is 0.25λ. In this case, the radiation pattern concentrates in an approximately vertical direction with respect to the antenna substrate 21. In other words, the radiation pattern indicates that, compared to a radiation pattern of a patch antenna having an average antenna gain in all directions, sensitivity in the vertical direction with respect to the antenna substrate 21 is high and a crosstalk caused by picking up a signal of an adjacent pixel is less likely to occur. Therefore, applying the resonant antenna 23 (a loop antenna) according to the present embodiment in which the distance 45 is 0.25λ to an image forming apparatus or the like reduces occurrences of a blur in an acquired image or, in other words, improves resolution as compared to a patch antenna. In addition, since a reflected wave and a scattered wave other than a terahertz wave directly arriving at the pixel are less likely to be received, noise in a received radio wave can be reduced.

Reflective Plate

In addition, as shown in FIG. 2, the directionality of the resonant antenna 23 can be further improved by providing the reflective plate 27 made of a metallic film on a side opposing the drive circuit substrate 11 of the antenna substrate 21. Hereinafter, details of the reflective plate 27 will be described. FIG. 8 is a perspective view of the antenna substrate 21 as seen from the vertical direction which shows resonant antennas 23 being arranged in an array and the reflective plate 27 being provided on a rear surface of the antenna substrate 21.

As described above, as means for adjusting a radiation pattern of an antenna, the reflective plate 27 may be provided on the rear surface of the antenna substrate 21, a front surface of the drive circuit substrate 11, or between the antenna substrate 21 and the drive circuit substrate 11. In other words, the reflective plate 27 may be provided between the resonant antenna 23 and the drive circuit substrate 11. In order to elicit an effect such as improving directionality from the reflective plate 27, by setting a distance between the resonant antenna 23 and the reflective plate 27 to around 0.5 times the resonance wavelength of the antenna substrate 21, a radiation pattern can be adjusted without degrading receiving sensitivity of a terahertz wave.

In addition, in order to have the reflective plate 27 also undertake a role of adjusting the directionality of the resonant antenna 23, the reflective plate 27 desirably covers a wider range than the resonant antenna 23 as shown in FIG. 8. More desirably, a range in which a distance from the resonant antenna 23 is 0.25λ or less is covered. Accordingly, since a large portion of a terahertz wave having propagated into the antenna substrate 21 is reflected by the reflective plate 27 without being affected by scattering or the like and is re-radiated into air, the radiation pattern can be concentrated in the vertical direction with respect to the antenna substrate 21.

In a state where reflective plates 27 are electrically connected between pixels, a terahertz wave may propagate through the reflective plates 27 which are made of conductive metal and, consequently, adjacent pixels may end up sharing a received terahertz wave. Therefore, in order to prevent crosstalk between pixels and prevent contamination by noise, the reflective plate 27 is desirably electrically insulated from other members as well as the reflective plates 27 of other pixels or, in other words, the reflective plate 27 is desirably in an electrically floating state.

Figure 9:
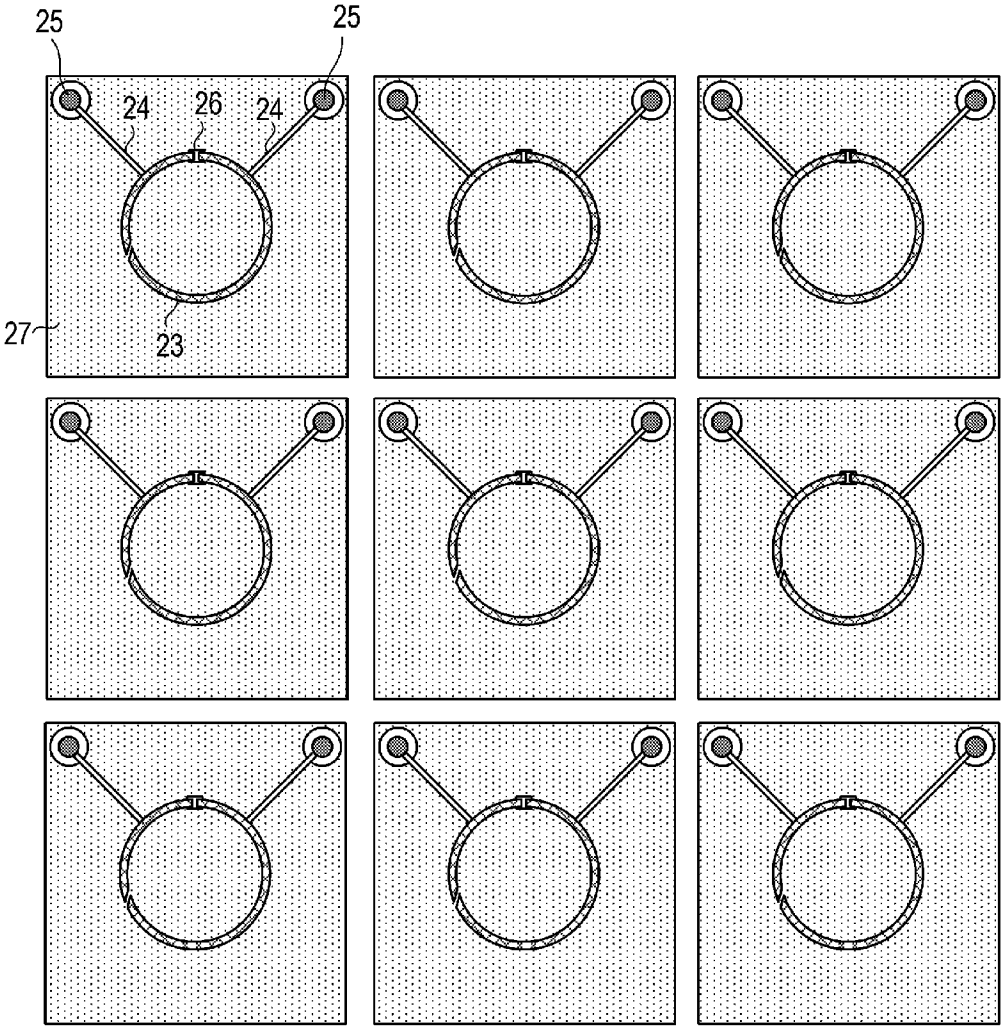
FIG. 9 is a diagram showing an illustrative arrangement of the reflective plate according to the first embodiment.

In addition, a terahertz wave not reflected by the reflective plate 27 may propagate along the ground wiring 34 or the like of the drive circuit substrate 11 bonded to the antenna substrate 21 and may be re-radiated toward the side of the antenna substrate 21 to become a crosstalk signal between pixels. Therefore, as shown in FIG. 9, in order to prevent the through electrode 25 and the reflective plate 27 from coming into electric contact with each other, the reflective plate 27 may be covered to such a degree that electric conduction does not occur between adjacent pixels. Accordingly, crosstalk that occurs when a terahertz wave incident on the antenna substrate 21 arrives at the drive circuit substrate 11 can be reduced.

Effects

Therefore, according to the present embodiment in which the distance 45 between the resonant antenna 23 and the through electrode 25 in a plan view is set to 0.25λ or more, a receiver can be obtained which has a radiation direction suitable for an image sensing apparatus and the like, which has high sensitivity and resolution, and which has low noise. In addition, since directionality of one resonant antenna 23 itself is high, higher definition can be achieved without having to increase a pixel area in the receiver. Furthermore, by shaping the radiation pattern of the resonant antenna 23 in the receiver using the reflective plate 27, receiving sensitivity of a terahertz wave can be improved.

First Modification

Figure 10:
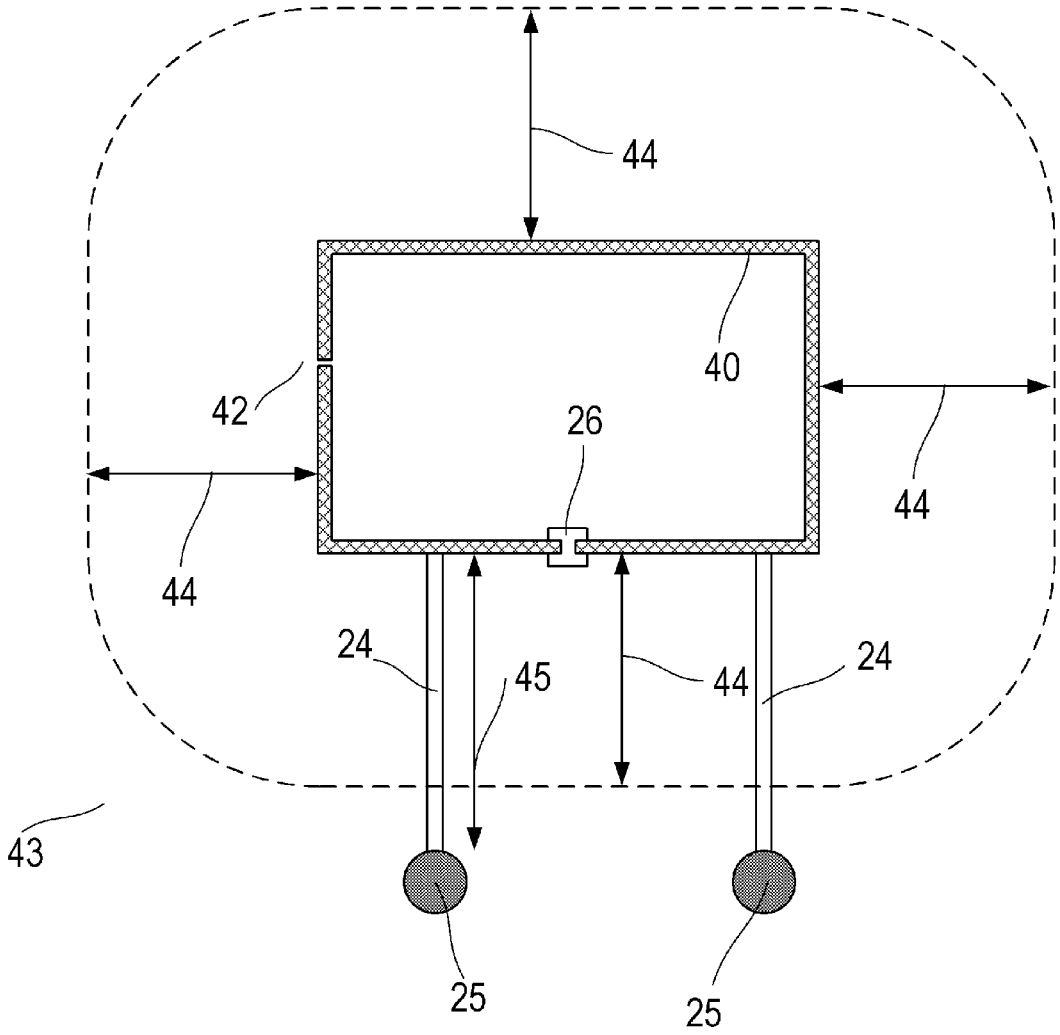
FIG. 10 is a diagram showing a resonant antenna and peripheral wirings according to a first modification.

While the resonant antenna 23 is described as a circular loop antenna in the first embodiment, in the present modification, the resonant antenna 23 will be described as a rectangular loop antenna as shown in FIG. 10. Although the resonant antenna 23 is given a rectangular shape in the present modification, the resonant antenna 23 can also have a polygonal shape. By giving the resonant antenna 23 a polygonal shape instead of a circular shape, a degree of design freedom can be increased and, when arranging the resonant antenna 23 in a two-dimensional array as a pixel of a receiver, the resonant antenna 23 can be made in a shape suitable for the arrangement.

It should be noted that a sum of lengths of sides of the resonant antenna 23 can be determined by a resonant frequency of the resonant antenna 23. Specifically, with respect to a wavelength λ (a resonance wavelength λ) of a radio wave with a frequency selected as the resonant frequency, a sum of the lengths of the sides of the resonant antenna 23 may be set to a length around $(n+0.5)\times\lambda$ (where n is 0 or a natural number) such as 0.5λ, 1.5λ, or 2.5λ. In this case, the resonance wavelength λ of the resonant antenna 23 can be expressed by a value combining relative permittivities of air surrounding the resonant antenna 23, the antenna substrate 21, an insulating film, and the like. This similarly applies to a case where the resonant antenna 23 is a polygon. In addition, even in the present modification, the effect of the through electrode 25 on a radiation pattern of the resonant antenna 23 can be suppressed by setting the distance 45 between the through electrode 25 and the resonant antenna 23 to 0.25λ or more in a similar manner to the first embodiment.

In the present modification, as described above, various degrees of design freedom are improved by giving the resonant antenna 23 a polygonal shape. For example, the resonant antenna 23 can be given a shape suitable for a pixel array arrangement. Since receiving sensitivity is affected by an opening area of the resonant antenna 23, an excessively elongated shape and a folded shape reduce the opening area and cause a decline in receiving sensitivity and are therefore not preferable.

In other words, according to the present modification, since the degree of design freedom of a receiver is improved, a receiver can be obtained which is further suitable for a pixel array arrangement, which has a radiation direction suitable for an image sensing apparatus and the like, which has high sensitivity and resolution, and which has low noise.

Second Modification

Figure 11:
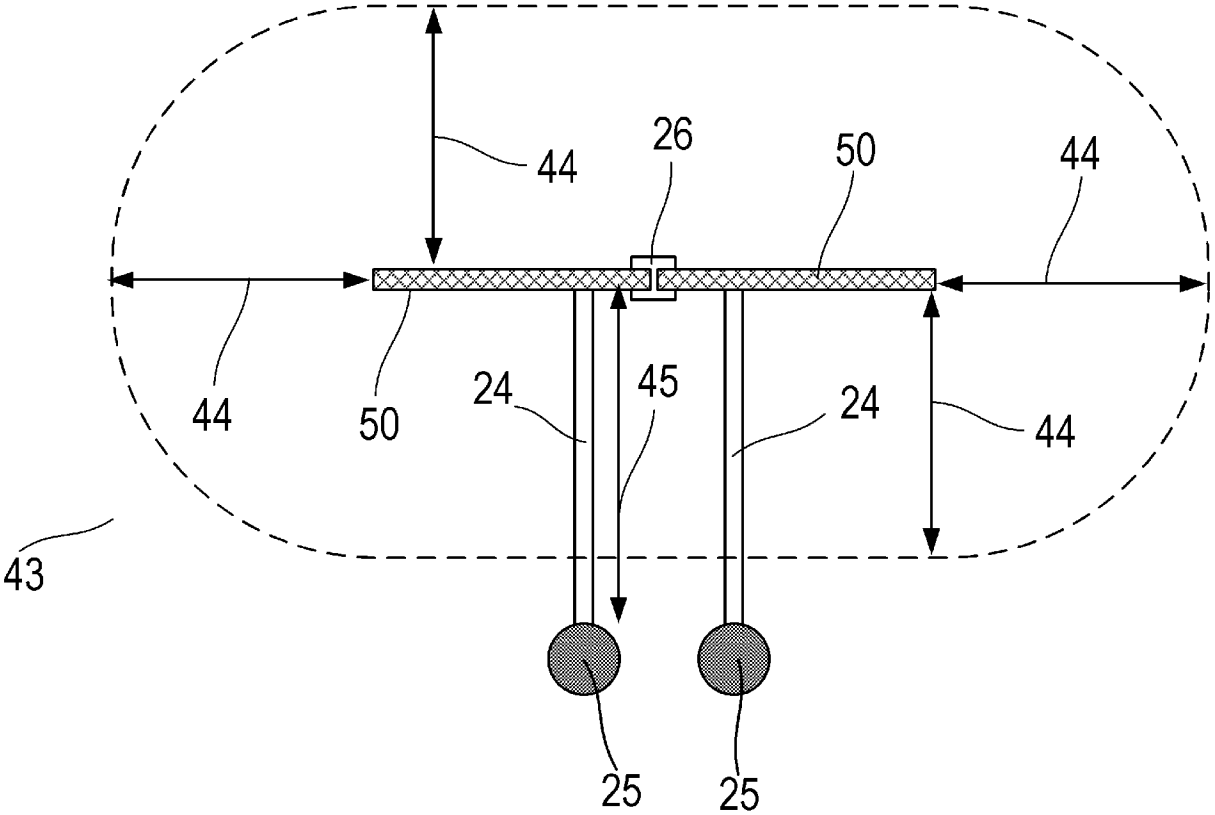
FIG. 11 is a diagram showing a resonant antenna and peripheral wirings according to a second modification.

While the resonant antenna 23 is described as a circular loop antenna in the first embodiment, in the present modification, the resonant antenna 23 will be described as a dipole antenna 50 as shown in FIG. 11.

It should be noted that a length of the dipole antenna 50 can be determined by a resonant frequency of the dipole antenna 50. Specifically, with respect to a wavelength λ (a resonance wavelength λ) of a radio wave with a frequency selected as the resonant frequency, the length of the dipole antenna 50 is generally set to a length around 0.5λ. In this case, the wavelength of the radio wave used when determining the length of the dipole antenna 50 can be expressed by a value combining relative permittivities of air surrounding the dipole antenna 50, the antenna substrate 21, an insulating film, and the like.

In addition, although two lengths of the dipole antenna 50 which sandwich the rectifying element 26 are symmetrical in FIG. 11, an impedance of the dipole antenna 50 can also be adjusted by making the two lengths respectively different while keeping a sum of the two lengths constant. In other words, impedance matching with the rectifying element 26 can be performed by adjusting asymmetry of the dipole antenna 50. In addition, in order to improve a directionality of the dipole antenna 50 according to the present modification, the reflective plate 27 made of a metallic film is provided between the antenna substrate 21 and the drive circuit substrate 11.

Furthermore, even in the present modification, the effect of the through electrode 25 on a radiation pattern of the dipole antenna 50 can be suppressed by setting the distance 45 between the through electrode 25 and the dipole antenna 50 to 0.25λ, or more in a similar manner to the first embodiment.

A degree of freedom of an array arrangement can be further improved by the dipole antenna 50 described in the present modification. In other words, according to the present modification, a receiver can be obtained which is further suitable for a pixel array arrangement, which has a radiation direction suitable for an image sensing apparatus, which has high sensitivity and resolution, and which has low noise.

First Example

In the present example, a more detailed configuration of the receiver according to the first embodiment will be described with reference to FIGS. 2 and 4. Specifically, a configuration of the antenna substrate 21 of the receiver according to the first embodiment will be mainly described below. As described above, the antenna substrate 21 made of a semiconductor material such as silicon has the resonant antenna 23, the lead-out line 24, the through electrode 25, the rectifying element 26, and the reflective plate 27. It should be noted that the present example will be described on the assumption that the receiver receives a terahertz wave with a frequency of 1 THz and a wavelength of 300 μm in air.

The resonant antenna 23 is provided on the antenna substrate 21. The resonant antenna 23 is constituted by a conductive metallic thin film such as aluminum. Since conductivity of the metallic thin film is related to antenna impedance, an adjustment related to impedance matching with the rectifying element 26 can be performed by changing the conductivity of the metallic thin film. In the present example, a 200 nm-thick film of aluminum is formed by a sputtering method and a shape of the resonant antenna 23 is formed by etching using a photoresist.

In addition, a length of a circumference of the resonant antenna 23 can be determined by the resonant frequency of the resonant antenna 23. A wavelength (a resonance wavelength) of a radio wave used when determining the length of the circumference (a resonator length) of the resonant antenna 23 can be calculated as a value combining relative permittivities of air surrounding the resonant antenna 23, the antenna substrate 21, an insulating film, and the like. In the present example, since the resonant frequency of the resonant antenna 23 is set to 1 THz, the resonator length of the resonant antenna 23 is 1.5 times the resonance wavelength 150 μm of the resonant antenna 23, and a diameter of the resonant antenna 23 is 70 In this case, since the resonant antenna 23 is in contact with two objects, namely, the antenna substrate 21 and air, the resonance wavelength of the resonant antenna 23 is significantly dependent on an average of dielectric constants of air and the antenna substrate 21. Therefore, in the present example, the resonance wavelength of the resonant antenna 23 is assumed to be 150 μm which is approximately half of the resonance wavelength 300 μm in air.

The resonant antenna 23 is provided with the notch 42 for driving the rectifying element 26. While the notch 42 enables a current or voltage supplied from the lead-out line 24 to be entirely applied to the rectifying element 26, a received terahertz wave with a frequency of 1 THz is desirably AC-coupled by capacitive coupling. In other words, since functionality of the resonant antenna 23 declines when the notch 42 is too wide, a width of the notch 42 is set to 1 μm in the present example. It should be noted that the lead-out line 24 is formed at the same time as the resonant antenna 23 using a same material.

The through electrode 25 is fabricated (generated) by the following procedure. First, the antenna substrate 21 and the drive circuit substrate 11 are joined to each other. In addition, a hole is opened in the antenna substrate 21 until the hole reaches the electrode pad 29 by a method such as dry etching at a location where the through electrode 25 is to be provided. Furthermore, a 1 μm-thick film of $SiO_2$ is formed on a side wall of the hole so that electric conduction does not occur between the through electrode 25 and the antenna substrate 21. Subsequently, the through electrode 25 is fabricated by fabricating a metal film in the hole by sputtering film deposition or plating. The through electrode 25 is desirably formed of a metal with large conductivity and, in the present example, the through electrode 25 is formed by plating growth of copper. Accordingly, drive voltage or a drive current generated from the drive circuit substrate 11 can be applied to both ends of the rectifying element 26 via the two through electrodes 25 and the lead-out line 24.

As the rectifying element 26, a Schottky barrier diode is fabricated in the present example in order to detect a frequency of a terahertz wave. Although details will be omitted, in order to fabricate a Schottky contact on the antenna substrate 21 made of silicon, an impurity concentration of the silicon surface of the antenna substrate 21 is brought down to $1\times10^{18}$ [atoms/cm$^3$] or lower. The impurity concentration of the surface can be controlled by various methods including directly growing a silicon crystal thin film having a desired impurity concentration by epitaxial growth and directly injecting impurity atoms into silicon by ion implantation or the like. In the present example, around 200 nm of n-type silicon having an impurity concentration of $2\times10^{16}$ [atoms/cm$^3$] is epitaxially grown on the surface of the antenna substrate 21 which is a silicon substrate. Since characteristics of a Schottky barrier diode is determined by a work function of silicon and metal, the characteristics significantly vary depending on a type of a metallic material used as an electrode. In the present example, 50 nm-thick cobalt is used as an electrode in the Schottky barrier diode. The rectifying element 26 and the resonant antenna 23 are electrically connected to each other via a contact hole opened in the insulating film that insulates the resonant antenna 23 and the antenna substrate 21 from each other.

The reflective plate 27 is provided on a surface on an opposite side to the resonant antenna 23 of the antenna substrate 21. In order to efficiently obtain an effect of improving directionality of the resonant antenna 23 or the like with the reflective plate 27, the thickness of the antenna substrate 21 is desirably set to around 0.5 times the resonance wavelength of the antenna substrate 21. In the present example, in order to receive a terahertz wave with a frequency of 1 THz and a wavelength of 300 μm in air, the antenna substrate 21 desirably has a thickness of around (300 μm/11.9)×0.5≈13 μm in consideration of the fact that silicon has a relative permittivity of 11.9. It should be noted that, since a dielectric constant of silicon in a case where the frequency of a terahertz wave is around 1 THz is not accurately known, in reality, an operation for adjusting (matching) the thickness must be performed during the generation of the through electrode 25. 1.5 μm-thick $SiO_2$ as an insulating film is present between the resonant antenna 23 and the antenna substrate 21 and, specifically, a film of $SiO_2$ is formed on the antenna substrate 21 by a chemical vapor deposition (CVD) method.

In addition, the antenna substrate 21 and the reflective plate 27 made of a metallic thin film are bonded (fabricated) via an insulating film so as to prevent the reflective plate 27 from coming into electrical contact with the antenna substrate 21. In the present example, the reflective plate 27 is fabricated by forming a 200 nm-thick film of SiN as an insulating film and subsequently forming a 200 nm-thick film of aluminum on top of SiN.

Furthermore, in the present example, a boundary of the region 43 suitable for disposing the through electrode 25 is favorably positioned so as to be separated from the resonant antenna 23 by 37 μm or more (37.5 μm or more) which is 0.25 times the resonance wavelength 150 μm of the resonant antenna 23. In addition, in the present example, the through electrode 25 is disposed at a position separated by 43 μm from the resonant antenna 23. Accordingly, a receiver can be provided which has high sensor sensitivity, in which cross-talk due to also picking up a signal of an adjacent pixel is less likely to occur, which has good resolution, and which has reduced noise.

In this manner, in the present example, the distance 45 is set to 37 μm or more since design is performed for the purpose of receiving a 1 THz terahertz wave. However, with a design for the purpose of receiving a 0.1 THz terahertz wave, since the resonance wavelength of the resonant antenna 23 is approximately 10 times that of a case where a 1 THz terahertz wave is received, the distance 45 may be set to 375 μm or more (370 μm or more). In addition, with a design for the purpose of receiving a 10 THz terahertz wave, since the resonance wavelength of the resonant antenna 23 is approximately 1/10 times that of a case where a 1 THz terahertz wave is received, the distance 45 may be set to 3.7 μm or more.

In a case where the purpose is to receive a 1 THz terahertz wave, since the antenna gain in the vertical direction assumes a saturation value when the distance 45 is 0.75 times the resonance wavelength, the distance 45 may be 150 μm×0.75=112.5≈112 μm or less. In addition, in the present example, the length of the resonant antenna 23 which is a loop antenna is 1.5 times the resonance wavelength 150 μm of the resonant antenna 23. However, this length is not restrictive, and since the length of the resonant antenna may be any of 0.5 times, 1.5 times, and 2.5 times the resonance wavelength, the length of the resonant antenna may be any of 75 μm, 225 μm, and 375 μm. Furthermore, when the resonant antenna 23 is a dipole antenna, a length of the dipole antenna may be 75 μm that is 0.5 times the resonance wavelength.

On the other hand, in a case where the purpose is to receive a 0.1 THz terahertz wave, the resonance wavelength of the resonant antenna 23 is 1500 μm. Therefore, since the antenna gain in the vertical direction assumes a saturation value when the distance 45 is 0.75 times the resonance wavelength, the distance 45 may be 1500 μm×0.75=1125 μm or less. In addition, since the length of the resonant antenna 23 which is a loop antenna may be any of 0.5 times, 1.5 times, and 2.5 times the resonance wavelength, the length of the resonant antenna may be any of 750 μm, 2250 μm, and 3750 μm. Furthermore, when the resonant antenna 23 is a dipole antenna, a length of the dipole antenna may be 750 μm that is 0.5 times the resonance wavelength.

In addition, for example, in a case where the purpose is to receive a 0.4 THz terahertz wave, the resonance wavelength of the resonant antenna 23 is 375 μm. Therefore, the distance 45 may be at least 375 μm×0.25=93.75≈93 μm and not more than 375 μm×0.75=281.25 281 μm. Furthermore, since the length of the resonant antenna 23 which is a loop antenna may be any of 0.5 times, 1.5 times, and 2.5 times the resonance wavelength, the length of the resonant antenna may be any of 187 μm, 562 μm, and 937 μm. Moreover, when the resonant antenna 23 is a dipole antenna, a length of the dipole antenna may be 187 μm that is 0.5 times the resonance wavelength.

The receivers according to the embodiment and the examples of the present invention can be applied to various applications. For example, the receivers according to the embodiment and the examples of the present invention can be suitably applied to an image forming apparatus (photographing apparatus; camera). Specifically, first, a terahertz wave is irradiated toward an object to be photographed by an oscillator outside the image forming apparatus. Next, the image forming apparatus receives an incident terahertz wave reflected by the object. In addition, an image processing unit acquires an electric signal output via the output terminal 19 from the output circuit 18 in the image forming apparatus, and the image processing unit forms an image on the basis of the electric signal. Since the electric signal is based on a terahertz wave received (detected) by a receiver according to the embodiment and the examples described above, the electric signal has reduced noise and contains information with high sensitivity. Therefore, the image forming apparatus can form (photograph) an image with reduced nose and high sensitivity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-157985, filed on Aug. 27, 2018 and Japanese Patent Application No. 2019-125295, filed on Jul. 4, 2019, which is hereby incorporated by reference herein in its entirety.

What is claimed is:

1. A receiver which is configured to detect a terahertz wave incident on a first surface of a substrate, the receiver comprising:

an antenna which is provided on the first surface of the substrate and is configured to receive the terahertz wave; and a through electrode which is electrically connected to the antenna and penetrates the substrate from the first surface to a second surface, the second surface being opposite to the first surface, wherein the through electrode is separated from the antenna by a distance that is 0.25 times a resonance wavelength or more.

2. The receiver according to claim 1, further comprising, on the first surface of the substrate, a rectifying element which is electrically connected to the antenna and is configured to generate a wave detection current of the terahertz wave.

3. The receiver according to claim 2, wherein the rectifying element is a Schottky barrier diode.

4. The receiver according to claim 1, wherein the through electrode is separated from the antenna by a distance that is at least 0.25 times the resonance wavelength and not more than 0.75 times the resonance wavelength.

5. The receiver according to claim 1, wherein the through electrode is electrically connected to an integrated circuit included in a second substrate that differs from the substrate, and wherein the second surface of the substrate and the second substrate are joined to each other.

6. The receiver according to claim 5, wherein a reflective plate constituted by a metallic film is included between the antenna and the second substrate.

7. The receiver according to claim 6, wherein the reflective plate is electrically floating.

8. The receiver according to claim 1, wherein the antenna is a loop antenna or a dipole antenna.

9. The receiver according to claim 8, wherein the antenna is a loop antenna, and wherein a length of the loop antenna is any of 0.5 times, 1.5 times, and 2.5 times the resonance wavelength.

10. The receiver according to claim 8, wherein the antenna is a dipole antenna, and wherein a length of the dipole antenna is 0.5 times the resonance wavelength.

11. The receiver according to claim 1, wherein a frequency of the terahertz wave is at least 0.03 THz and not more than 30 THz.

12. The receiver according to claim 1, further comprising an output circuit which is configured to output an electric signal based on the terahertz wave outside.

13. An image forming apparatus, comprising:

the receiver according to claim 12; and an image processing unit which is configured to form an image based on the electric signal.

14. A receiver which is configured to detect a terahertz wave incident on a first surface of a substrate, the receiver comprising:

an antenna which is provided on the first surface of the substrate and is configured to receive the terahertz wave; and a through electrode which is electrically connected to the antenna and penetrates the substrate from the first surface to a second surface, the second surface being a surface opposite to the first surface, wherein a distance from the through electrode to the antenna is 37 μm or more.

15. The receiver according to claim 14, wherein the distance from the through electrode to the antenna is 112 μm or less.

16. The receiver according to claim 14, wherein the distance from the through electrode to the antenna is 375 μm or more.

17. The receiver according to claim 14, wherein the distance from the through electrode to the antenna is 1125 μm or less.

18. The receiver according to claim 14, wherein the antenna is a loop antenna, and wherein a length of the loop antenna is any of 75 μm, 225 μm, 375 μm, 750 μm, 2250 μm, and 3750 μm.

19. The receiver according to claim 14, wherein the antenna is a dipole antenna, and wherein a length of the dipole antenna is 75 μm or 750 μm.

20. An image forming apparatus, comprising:

the receiver according to claim 14; and an output circuit which is configured to output an electric signal based on the terahertz wave outside, an image processing unit which is configured to form an image based on the electric signal.

* * * * *